US012379119B2

(12) United States Patent
Steen et al.

(10) Patent No.: US 12,379,119 B2
(45) Date of Patent: Aug. 5, 2025

(54) VALVE UNIT FOR A HEAT-PUMP SYSTEM AND METHOD FOR ASSEMBLING THE SAME

(71) Applicants: DAIKIN INDUSTRIES, LTD., Osaka (JP); DAIKIN EUROPE N.V., Ostend (BE)

(72) Inventors: David Steen, Ostend (BE); Kevin Cornelis, Ostend (BE); Arne Degrande, Ostend (BE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 159 days.

(21) Appl. No.: 17/931,551

(22) Filed: Sep. 13, 2022

(65) Prior Publication Data

US 2023/0003404 A1 Jan. 5, 2023

Related U.S. Application Data

(63) Continuation of application No. PCT/JP2021/005527, filed on Feb. 15, 2021.

(30) Foreign Application Priority Data

Apr. 30, 2020 (EP) ..... 20172339

(51) Int. Cl.
*F24F 11/36* (2018.01)
*F24F 11/00* (2018.01)
(Continued)

(52) U.S. Cl.
CPC ..... *F24F 11/36* (2018.01); *F24F 11/0001* (2013.01); *F24F 13/1426* (2013.01);
(Continued)

(58) Field of Classification Search
CPC ..... F25B 2500/22; F25B 2500/222
See application file for complete search history.

(56) References Cited

U.S. PATENT DOCUMENTS

2012/0292006 A1* 11/2012 Yamashita ..... F24F 3/06 165/200
2013/0192283 A1* 8/2013 Yamashita ..... F24F 3/08 62/126

(Continued)

FOREIGN PATENT DOCUMENTS

EP 2535651 A1 12/2012
EP 3091314 A1 11/2016

(Continued)

OTHER PUBLICATIONS

Written Opinion issued in corresponding International Application No. PCT/JP2021/005527 mailed May 14, 2021 (6 pages).

(Continued)

*Primary Examiner* — Jerry-Daryl Fletcher
*Assistant Examiner* — Daniel C Comings
(74) *Attorney, Agent, or Firm* — Osha Bergman Watanabe & Burton LLP

(57) ABSTRACT

A valve unit for a heat-pump system, includes: a liquid refrigerant pipe portion; a gas refrigerant pipe portion; a liquid control valve disposed in the liquid refrigerant pipe portion; a gas control valve disposed in the gas refrigerant pipe portion; a casing accommodating the liquid control valve and the gas control valve; and an air-discharge mechanism that discharges air in an internal space of the casing to an external space outside the casing in response to a refrigerant leakage in the casing.

16 Claims, 4 Drawing Sheets

(51) Int. Cl.
*F24F 13/14* (2006.01)
*F24F 13/20* (2006.01)

(52) U.S. Cl.
CPC ..... *F24F 2013/1433* (2013.01); *F24F 13/20* (2013.01); *F25B 2500/222* (2013.01)

(56) References Cited

U.S. PATENT DOCUMENTS

| | | | | |
|---|---|---|---|---|
| 2014/0033754 | A1* | 2/2014 | Hatomura | F25D 29/006 62/190 |
| 2019/0234660 | A1 | 8/2019 | Yamada et al. | |
| 2021/0356154 | A1* | 11/2021 | Kobayashi | F25B 49/02 |

FOREIGN PATENT DOCUMENTS

| | | | | |
|---|---|---|---|---|
| EP | 3282203 | A1 | 2/2018 | |
| JP | 2014-163657 | A | 9/2014 | |
| JP | 2016-196996 | A | 11/2016 | |
| JP | 2018-077040 | A | 5/2018 | |
| JP | 6528909 | B2 * | 6/2019 | F25B 1/00 |
| JP | 2020-051736 | A | 4/2020 | |
| WO | 2011/099065 | A1 | 8/2011 | |
| WO | 2018/062528 | A1 | 4/2018 | |
| WO | WO-2020067040 | A1 * | 4/2020 | F24F 11/36 |

OTHER PUBLICATIONS

International Search Report issued in corresponding International Application No. PCT/JP2021/005527 mailed May 14, 2021 (3 pages).

Extended European Search Report issued in corresponding European Patent Application No. EP 20172339.2 dated Oct. 6, 2020 (7 pages).

International Preliminary Report on Patentability issued in corresponding International Application No. PCT/JP2021/005527 mailed Nov. 10, 2022 (8 pages).

* cited by examiner

VALVE UNIT FOR A HEAT-PUMP SYSTEM AND METHOD FOR ASSEMBLING THE SAME

CROSS-REFERENCE TO RELATED APPLICATIONS

This is a continuation application of International Patent Application No. PCT/JP2021/005527, filed on Feb. 15, 2021, and claims priority to European Patent Application No. 20172339.2, filed on Apr. 30, 2020. The contents of these priority applications are incorporated herein by reference.

TECHNICAL FIELD

The present disclosure relates to a valve unit used for a heat-pump system and a method for assembling such a valve unit.

BACKGROUND

EP 3 091 314 A1 proposes a valve unit used for a heat-pump system. This valve unit includes a liquid control valve disposed in a liquid refrigerant pipe, a gas control valve disposed in a gas refrigerant pipe, and a casing covering the liquid control valve and the gas control valve. Each valve tends to become a leakage point of refrigerant, and thus needs to be regularly checked by a monitoring person and also repaired by a maintenance person as necessary.

However, when a refrigerant leakage occurred, the internal space of the casing would have already been permeated with a significant amount of leaked refrigerant when the monitoring/maintenance person arrives and opens the casing. For instance, some refrigerants used are flammable or slightly flammable. Hence, opening such a casing is undesirable from safety perspective. Meanwhile, if the valves are not covered by the casing, leaked refrigerant would immediately spread to the surrounding area.

SUMMARY

One or more embodiments of the present disclosure provide a valve unit with high safety regarding refrigerant leakage, and provide a method for assembling such a valve unit.

One or more embodiments of the present disclosure provide a valve unit used for a heat-pump system, comprising: at least one liquid refrigerant pipe portion; at least one gas refrigerant pipe portion; at least one liquid control valve disposed in the liquid refrigerant pipe portion; at least one gas control valve disposed in the gas refrigerant pipe portion; a casing accommodating at least the liquid control valve and the gas control valve; and an air-discharge mechanism configured to operate to discharge an air in an internal space of the casing to an external space outside the casing when a refrigerant leakage in the casing has occurred.

With the above configuration, even if a refrigerant leakage has occurred at the valves, the casing can prevent or restrain the leaked refrigerant from spreading to a surrounding area. Moreover, concentration of the leaked refrigerant in the internal space of the casing can be decreased by discharging the air in the internal space to an external space of the casing. This external space may not be an outer space directly surrounding the casing or an indoor space where a human or animal could come or reside. The external space may be an outdoor space.

Furthermore, the valve unit may be configured such that the internal space of the casing is substantially closed in normal times, and a refrigerant leakage detection may be made based on concentration of refrigerant in the internal space of the casing. In this case, it is possible to swiftly detect an occurrence of a refrigerant leakage in the casing and start operation of the air-discharge mechanism at an early stage. Hence, it is possible to prevent concentration of the leaked refrigerant in both the casing and the surrounding area from becoming high in a more secure manner. This allows the monitoring/maintenance person to safely monitor, maintain, or repair the valves. Accordingly, it is possible to improve safety of the valve unit regarding refrigerant leakage.

The pipe portions, the valves and the casings, and the air-discharge mechanism, may be manufactured together. In this case, it is easier to design the valve unit so as to enhance its performance such as airtightness of the casing and air-discharge efficiency of the air-discharge mechanism. It is also easier to optimize the dimension of the valve unit, a position of a maintenance door of the casing, and the capacity of the air-discharge mechanism. Hence, it is possible to improve not only safety but also maintainability and functionality of the valve unit. Alternatively, the casing may be a retrofitted casing which is to be assembled around existing valves.

According to one or more embodiments of the valve unit mentioned above, the air-discharge mechanism includes: a fan configured to draw the air from the internal space towards the external space.

With the above configuration, it is possible to effectively discharge the air in the casing when a refrigerant leakage in the casing has occurred. In a case where the casing has a part exposed to the outdoor space, an outlet of the fan may be disposed in this part. In a case where the casing does not have any part exposed to the outdoor space, an air duct extending from the casing to the outdoor space may be arranged, and the fan may be disposed in or attached to the air duct. The fan may be arranged at the outer end of the air duct. Thereby, the full air duct can be kept in under pressure, preventing the air containing refrigerant from leaking from the duct.

According to one or more embodiments of the valve unit mentioned above with the fan, an opening is formed in the casing, and the air-discharge mechanism further includes a check air damper configured to allow an air to flow from an outside of the casing towards the internal space through the opening when the fan is in operation.

With the above configuration, the discharge of the air in the internal space of the casing can be promoted by replacing it with an external air. Thus, it is possible to more effectively discharge the air in the casing when a refrigerant leakage in the casing has occurred. Moreover, since the check air damper can keep a closed state when the fan is not in operation, the airtightness of the casing can be maintained.

According to one or more embodiments of any one of the valve units mentioned above, the valve unit further comprises: a sensor configured to detect a concentration of the refrigerant in the air in the casing; and a controller configured to determine that a refrigerant leakage in the casing has occurred when the detected concentration is equal to or greater than a detection value threshold, and control the air-discharge mechanism to start operation when the refrigerant leakage has occurred.

With the above configuration, the concentration of refrigerant in the internal space of the casing can be prevented from becoming high even when a refrigerant leakage in the casing has occurred. Thus, it is possible to achieve the safety of the valve unit in a more secure manner.

According to one or more embodiments of any one of the valve units mentioned above with the controller, the liquid refrigerant pipe portion and the gas refrigerant pipe portion form a part of a liquid refrigerant pipe and a part of a gas refrigerant pipe, respectively, which extend between a heat-source-side heat exchanger and a utilization-side heat exchanger of the heat-pump system; and the controller is further configured to control the liquid control valve and the gas control valve to close when a refrigerant leakage in a utilization-side piping section has occurred, the utilization-side piping section extending between the liquid control valve and the gas control valve and including at least the utilization-side heat exchanger.

With the above configuration, it is possible to restrain or stop further supply of refrigerant to the utilization-side piping section when a refrigerant leakage in the utilization-side piping section has occurred. Thereby, further refrigerant leakage from the utilization-side piping section, e.g. from the utilization-side heat exchanger, can be restrained or stopped. The liquid control valve and the gas control valve may be shut-off valves. Moreover, it is possible to divide a refrigerant circuit of the heat-pump system into smaller sections, which are arranged for different spaces. There is a case where ratio of a total refrigerant amount in each circuit section with respect to total volume of a space in which the circuit section extends is legally restricted. Even in such a case, the above configuration allows the air-conditioning system to be easily applied to a facility having relatively small spaces, while ensuring high safety at a low cost. Furthermore, although the valves themselves could be refrigerant leakage points, they are also disposed inside the casing. Thus, it is possible to obtain the above-mentioned effects without impairing safety of other locations regarding refrigerant leakage.

According to one or more embodiments of the valve unit mentioned above with the check air damper and the controller, the check air damper is configured to be operated by an electric motor, and the controller is configured to control the electric motor to open the check air damper when a refrigerant leakage in the casing has occurred.

With the above configuration, it is possible to more effectively and securely discharge the air in the casing when a refrigerant leakage in the casing has occurred.

According to one or more embodiments of any one of the valve units mentioned above with the controller, the controller is further configured to output alarm information when a refrigerant leakage in the casing or a refrigerant leakage in the utilization-side piping section has occurred.

With the above configuration, it is possible to notify the monitoring/maintenance person and/or an external information output device of an occurrence of a refrigerant leakage in the casing or the utilization-side piping section. Thus, the safety of the valve unit and/or the air-conditioning system can be further improved.

According to one or more embodiments of any one of the valve units mentioned above, the at least one gas refrigerant pipe portion includes a low-pressure gas pipe portion, a high-pressure gas pipe portion, and a utilization-side gas pipe portion branching into the low-pressure gas pipe portion and the high-pressure gas pipe portion; the at least one liquid control valve includes a liquid shut-off valve disposed in the liquid refrigerant pipe portion; and the at least one gas control valve includes a low-pressure gas control valve disposed in the low-pressure gas pipe portion, a high-pressure gas control valve disposed in the high-pressure gas pipe portion, and a gas shut-off valve disposed in the utilization-side gas pipe portion.

With the above configuration, the valve unit can switch whether the utilization-side gas pipe portion is communicated with the low-pressure gas pipe portion or the high-pressure gas pipe portion.

For instance, the liquid refrigerant pipe portion is selectively communicated with a condenser and an evaporator as heatsource-side heat exchangers disposed in a heatsource-side unit and with a utilization-side heat exchanger disposed in a utilization-side unit. The low-pressure gas pipe portion is communicated with the suction port of a refrigerant compressor disposed in the heatsource-side unit. The high-pressure gas pipe portion is communicated with the discharge port of the refrigerant compressor disposed in the heatsource-side unit. The utilization-side gas pipe portion is communicated with the utilization-side heat exchanger. In this case, the valve unit can function as a branch selector which allows operation state of the utilization-side unit to easily switch between cooling operation in which the utilization-side heat exchanger functions as an evaporator and heating operation in which the utilization-side heat exchanger functions as a condenser.

According to one or more embodiments of any one of the valve units mentioned above, the at least one liquid refrigerant pipe portion includes a plurality of utilization-side liquid pipe portions, and a heatsource-side liquid pipe portion branching into the utilization-side liquid pipe portions; the at least one gas refrigerant pipe portion includes a plurality of utilization-side gas pipe portions, and a heatsource-side gas pipe portion branching into the utilization-side gas pipe portions; the at least one liquid control valve includes a plurality of liquid shut-off valves disposed in the utilization-side liquid pipe portions, respectively, the at least one gas control valve includes a plurality of gas shut-off valves disposed in the utilization-side gas pipe portions, respectively.

With the above configuration, the plurality of utilization-side gas pipe portions are connected with the common heatsource-side gas pipe portion, and the plurality of utilization-side liquid pipe portions are connected with the common heatsource-side liquid pipe portion.

For instance, the heatsource-side liquid pipe portion is communicated with a heatsource-side heat exchanger disposed in a heatsource-side unit. The utilization-side liquid pipe portions are connected with a plurality of utilization-side heat exchangers disposed in a plurality of utilization-side units, respectively. The heatsource-side gas pipe portion is communicated with a refrigerant compressor disposed in the heatsource-side unit. The utilization-side gas pipe portions are connected with the utilization-side heat exchangers, respectively. In this case, the valve unit can function as a refrigerant branch unit which allows the plurality of utilization-side units to share the common heatsource-side unit.

According to one or more embodiments of any one of the valve units mentioned above, the at least one liquid refrigerant pipe portion includes a plurality of utilization-side liquid pipe portions, and a heatsource-side liquid pipe portion branching into the utilization-side liquid pipe portions; the at least one gas refrigerant pipe portion includes a plurality of low-pressure gas sub pipes, a low-pressure gas pipe portion branching into the low-pressure gas sub pipes, a plurality of high-pressure gas sub pipes, a high-pressure gas pipe portion branching into the high-pressure gas sub pipes, and a plurality of utilization-side gas pipe portions each branching into one of the low-pressure gas sub pipes and one of the high-pressure gas sub pipes so as to be connected to the low-pressure gas pipe portion and the high-pressure gas pipe portion via the low-pressure gas sub pipe and the high-pressure gas sub pipe, respectively; the at least one liquid control valve includes a plurality of liquid shut-off valves disposed in the utilization-side liquid pipe portions, respectively; and the at least one gas control valve includes a plurality of low-pressure gas control valves disposed in the low-pressure gas sub pipes, respectively, a plurality of high-pressure gas control valves disposed in the high-pressure gas sub pipes, respectively, and a plurality of gas shut-off valves disposed in the utilization-side gas pipe portions, respectively.

With the above configuration, the valve unit can function as a multi branch selector in which the functions of the branch selector and the refrigerant branch unit mentioned above are integrated. The multi branch selector achieves an individual air-conditioning of a plurality of utilization-side units while sharing the same heatsource-side unit. Meanwhile, the multi branch selector tends to include a number of the branching/merging points and valves, and thus have a number of possible refrigerant leakage points. With the above configuration, such a lot of possible refrigerant leakage points can be disposed inside the casing.

According to one or more embodiments of any one of the valve units mentioned above, the valve unit further comprises: insulators applied to the casing such that an internal space of the casing is isolated from an outer space surrounding the casing at least when the air-discharge mechanism is not in operation.

With the above configuration, the internal space of the casing can be substantially closed at least when the air-discharge mechanism is not in operation. Thereby, when a refrigerant leakage at the valves has occurred, it is possible to prevent the leaked refrigerant from spreading to surrounding area and detect an occurrence of a refrigerant leakage in the casing more swiftly.

According to one or more embodiments of any one of the valve units mentioned above with the low-pressure gas control valve and the high-pressure gas control valve, a minute channel is formed in at least one of the low-pressure gas control valve and the high-pressure gas control valve, the minute channel being configured and arranged to enable refrigerant to flow through the minute channel even when an opening degree of the at least one of the low-pressure gas control valve and the high-pressure gas control valve is set to be the lowest degree.

With the above configuration, a formation of a liquid seal circuit within the refrigerant circuit can be prevented by the minute channel, without separately providing a bypass circuit for inhibiting liquid sealing. Thus, it is possible to improve reliability of the air-conditioning system at a low cost.

According to one or more embodiments of any one of the valve units mentioned above, the refrigerant is R32 refrigerant.

R32 refrigerant, which is also called HFC-32 refrigerant or difluoromethane refrigerant and with a chemical formula of CH2F2, has characteristics of the zero-ozone depletion potential and the low global warming potential while being slightly flammable. Thus, it is possible to achieve an eco-friendly air-conditioner while ensuring high safety regarding refrigerant leakage.

One or more embodiments of the present disclosure provide a method for assembling any one of the valve units mentioned above, wherein the casing is formed from a plurality of casing parts, comprising: arranging the casing parts around at least the liquid control valve and the gas control valve; and fixing the casing parts to each other.

By the above process, the above-mentioned effects of any one of the valve units mentioned above can be achieved with the existing liquid control valve and gas control valve. The method may further include assembling a unit having the liquid refrigerant pipe portion, the gas refrigerant pipe portion, the liquid control valve, and the gas control valve before arranging the casing parts.

According to one or more embodiments of the method mentioned above, the method further comprises attaching the air-discharge mechanism to the casing.

By the above process, it is possible to separately assemble the air-discharge mechanism to the casing before or after fixing the casing parts to each other.

DETAILED DESCRIPTION

One or more embodiments of a valve unit according to the present disclosure will be described with reference to the drawings. The valve unit according to one or more embodiments is, for instance, used for a multi air-conditioning system with a so-called three-pipe configuration, which includes a heatsource-side unit and a plurality of utilization-side units and uses R32 refrigerant.

Configuration of Unit

Figure 1:
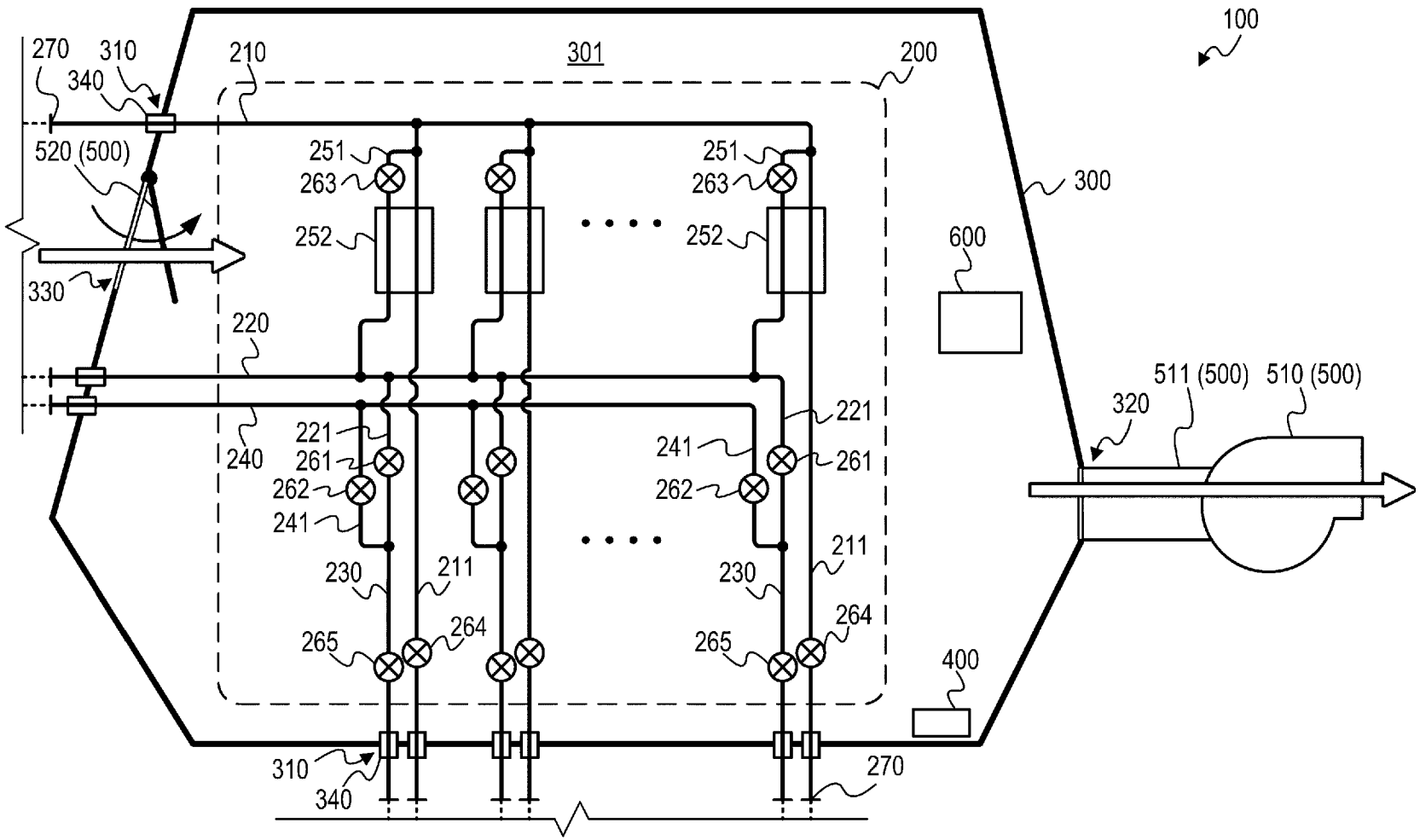
FIG. 1 shows a schematic configuration diagram of a valve unit according to one or more embodiments of the present disclosure.

FIG. 1 is a schematic configuration diagram of the valve unit according to one or more embodiments.

As shown in FIG. 1, the valve unit 100 comprises a multi branch selector 200, a casing 300, a sensor 400, an air-discharge mechanism 500, and a controller 600. The casing 300 accommodates the multi branch selector 200 therein. The air-discharge mechanism 500 is mounted on or connected to the casing 300. In one or more embodiments, the air-discharge mechanism 500 comprises a fan 510 and a check air damper 520. The sensor 400 and the controller 600 are disposed in an internal space 301 of the casing 300. Yet, the controller 600 may be disposed on or outside the casing 300.

The multi branch selector 200 includes a heatsource-side liquid pipe portion 210, a plurality of utilization-side liquid pipe portions 211, a low-pressure gas pipe portion 220, a plurality of low-pressure gas sub pipes 221, a plurality of utilization-side gas pipe portions 230, a high-pressure gas pipe portion 240, a plurality of high-pressure gas sub pipes 241, a plurality of bypass pipes 251, and a plurality of refrigerant heat exchangers 252. The multi branch selector 200 further includes a plurality of low-pressure gas control valves 261, a plurality of high-pressure gas control valves 262, a plurality of expansion mechanisms 263, a plurality of liquid shut-off valves 264, and a plurality of gas shut-off valves 265.

The numbers of the utilization-side liquid pipe portions 211, the low-pressure gas sub pipes 221, the utilization-side gas pipe portions 230, the high-pressure gas sub pipes 241, the bypass pipes 251, the refrigerant heat exchangers 252, the low-pressure gas control valves 261, the high-pressure gas control valves 262, the expansion mechanisms 263, the liquid shut-off valves 264, and the gas shut-off valves 265 may be the same. One of the utilization-side liquid pipe portions 211 and one of the utilization-side gas pipe portions 230 are communicated with the same utilization-side heat exchanger. Thus, the above number may correspond to the number of the utilization-side units (not shown) of the heat-pump system. The above number is not limited to a specific number.

The heatsource-side liquid pipe portion 210 is communicated with each of a condenser and an evaporator (heatsource-side heat exchangers) disposed in the heatsource-side unit (not shown) outside the casing 300. The heatsource-side liquid pipe portion 210 branches into the utilization-side liquid pipe portions 211 in the multi branch selector 200. The utilization-side liquid pipe portions 211 are communicated with a plurality of utilization-side heat exchangers disposed in the utilization-side units (not shown) outside the casing 300, respectively.

In other words, the heatsource-side liquid pipe portion 210 and each of the utilization-side liquid pipe portions 211 form a part of a liquid refrigerant pipe of a heat-pump system.

The low-pressure gas pipe portion 220 is communicated with the suction-side of a refrigerant compressor (not shown) disposed in the heatsource-side unit outside the casing 300. The low-pressure gas pipe portion 220 branches into the low-pressure gas sub pipes 221 in the multi branch selector 200. The low-pressure gas sub pipes 221 are connected with the utilization-side gas pipe portions 230, respectively. The utilization-side gas pipe portions 230 are communicated with the utilization-side heat exchangers disposed in the utilization-side units outside the casing 300, respectively. It can also be explained that the low-pressure gas pipe portion 220 branches into the utilization-side gas pipe portions 230 via the low-pressure gas sub pipes 221.

In other words, the low-pressure gas pipe portion 220, each of the low-pressure gas sub pipes 221, and each of the utilization-side gas pipe portions 230 form a part of a low-pressure gas refrigerant pipe of the heat-pump system.

The high-pressure gas pipe portion 240 is communicated with a discharge-side of the refrigerant compressor outside the casing 300. The high-pressure gas pipe portion 240 branches into the high-pressure gas sub pipes 241 in the multi branch selector 200. The high-pressure gas sub pipes 241 are connected with the utilization-side gas pipe portions 230, respectively. It can also be explained that the high-pressure gas pipe portion 240 branches into the utilization-side gas pipe portions 230 via the high-pressure gas sub pipes 241. It can also be said that each utilization-side gas pipe portions 230 branches into the low-pressure gas pipe portion 220 and the high-pressure gas pipe portion 240 via one of the low-pressure gas sub pipes 221 and one of the high-pressure gas sub pipes 241.

In other words, the high-pressure gas pipe portion 240, each of the high-pressure gas sub pipes 241, and each of the utilization-side gas pipe portions 230 form a part of a high-pressure gas refrigerant pipe of the heat-pump system.

The bypass pipes 251 are connected with the utilization-side liquid pipe portions 211, respectively, and each connected with the low-pressure gas pipe portion 220. In other words, each bypass pipe 251 branches from one of the utilization-side liquid pipe portions 211 and merges with the low-pressure gas pipe portion 220.

The expansion mechanisms 263 are disposed in the bypass pipes 251, respectively. Each expansion mechanism 263 is configured to decompress and expand refrigerant flowing from the corresponding utilization-side liquid pipe portion 211 in the bypass pipe 251. Each expansion mechanism 263 may be an electric expansion valve.

The refrigerant heat exchangers 252 are provided to the bypass pipes 251, respectively. Each refrigerant heat exchanger 252 is configured to cause a heat-exchange between refrigerant flowing in one of the utilization-side liquid pipe portions 211 and refrigerant flowing in the corresponding bypass pipe 251 that has been decompressed and expanded by the corresponding expansion mechanism 263. In other words, each refrigerant heat exchanger 252 forms a subcooling system in combination with the corresponding utilization-side liquid pipe portion 211, bypass pipe 251, and expansion mechanism 263. Each refrigerant heat exchanger 252 may have two flow channels which form a part of the utilization-side liquid pipe portion 211 and a part of the bypass pipe 251, respectively, and have thermal conductance therebetween.

The low-pressure gas control valves 261 are disposed in the low-pressure gas sub pipes 221, respectively. Each low-pressure gas control valve 261 is configured to switch between an open state and a closed state, i.e. whether or not to allow refrigerant to flow between the low-pressure gas pipe portion 220 and the corresponding utilization-side gas pipe portion 230. The state of each low-pressure gas control valve 261 is controlled by the controller 600 in accordance with an operation mode desired for the corresponding utilization-side unit. Each low-pressure gas control valve 261 may be an electric valve.

The high-pressure gas control valves 262 are disposed in the high-pressure gas sub pipes 241, respectively. Each high-pressure gas control valve 262 is configured to switch between an open state and a closed state, i.e. whether or not to allow refrigerant to flow between the high-pressure gas pipe portion 240 and the corresponding utilization-side gas pipe portion 230. The state of each high-pressure gas control valve 262 is controlled by the controller 600 in accordance with an operation mode desired for the corresponding utilization-side unit, for instance. Each high-pressure gas control valve 262 may be an electric valve.

A minute channel may be formed in each of the low-pressure gas control valves 261 and/or each of the high-pressure gas control valves 262. The minute channel is configured and arranged to enable refrigerant to flow through the minute channel even when an opening degree of the valve is set to be the lowest degree.

The liquid shut-off valves 264 are disposed in the utilization-side liquid pipe portions 211, respectively. The gas shut-off valves 265 are disposed in the utilization-side gas pipe portions 230, respectively. The liquid shut-off valve 264 and the gas shut-off valve 265 disposed in the utilization-side liquid pipe portion 211 and the utilization-side gas pipe portion 230 which are communicated with the same utilization-side heat exchanger define a utilization-side piping section which extends therebetween and includes at least the utilization-side heat exchanger. Each of the liquid shut-off valves 264 and the gas shut-off valves 265 may be an electric valve.

The casing 300 may have a substantially box shape, and is large enough to accommodate the multi branch selector 200 therein. The casing 300 may be made of metal plates, carbon fibre plates, fire-retardant resin plates, or the like. The casing 300 is formed with a plurality of pipe apertures 310, a discharge opening 320, and an intake opening 330. The casing 300 may comprise a plurality of casing parts which are attachable to and detachable from each other. In this case, the casing parts may be structured such that each of the pipe apertures 310 is formed between two or more of the adjoining casing parts.

The plurality of pipe apertures 310 are configured to allow the pipes extending from the multi branch selector 200 (hereinafter referred to as "the extending pipes") to pass therethrough, respectively. In other words, the plurality of pipe apertures 310 are formed at positions corresponding to the positions of the extending pipes, and each have diameter greater than the diameter of the corresponding extending pipe. In a case where each of the pipe apertures 310 is formed between two or more of the casing parts as mentioned above, each extending pipe can easily be fitted into the corresponding pipe aperture 310 when the casing parts are assembled. Here, such extending pipes include the heatsource-side liquid pipe portion 210, the low-pressure gas pipe portion 220, the high-pressure gas pipe portion 240, the utilization-side liquid pipe portions 211, and the utilization-side gas pipe portions 230.

Each of the extending pipes may have a pipe connection part 270 for being connected with the corresponding outer pipes, i.e. the other parts of the liquid refrigerant pipe, the low-pressure gas refrigerant pipe, and the high-pressure gas refrigerant pipe of the heat-pump system. The pipe connection parts 270 may be arranged outside of the casing 300.

Figure 5:
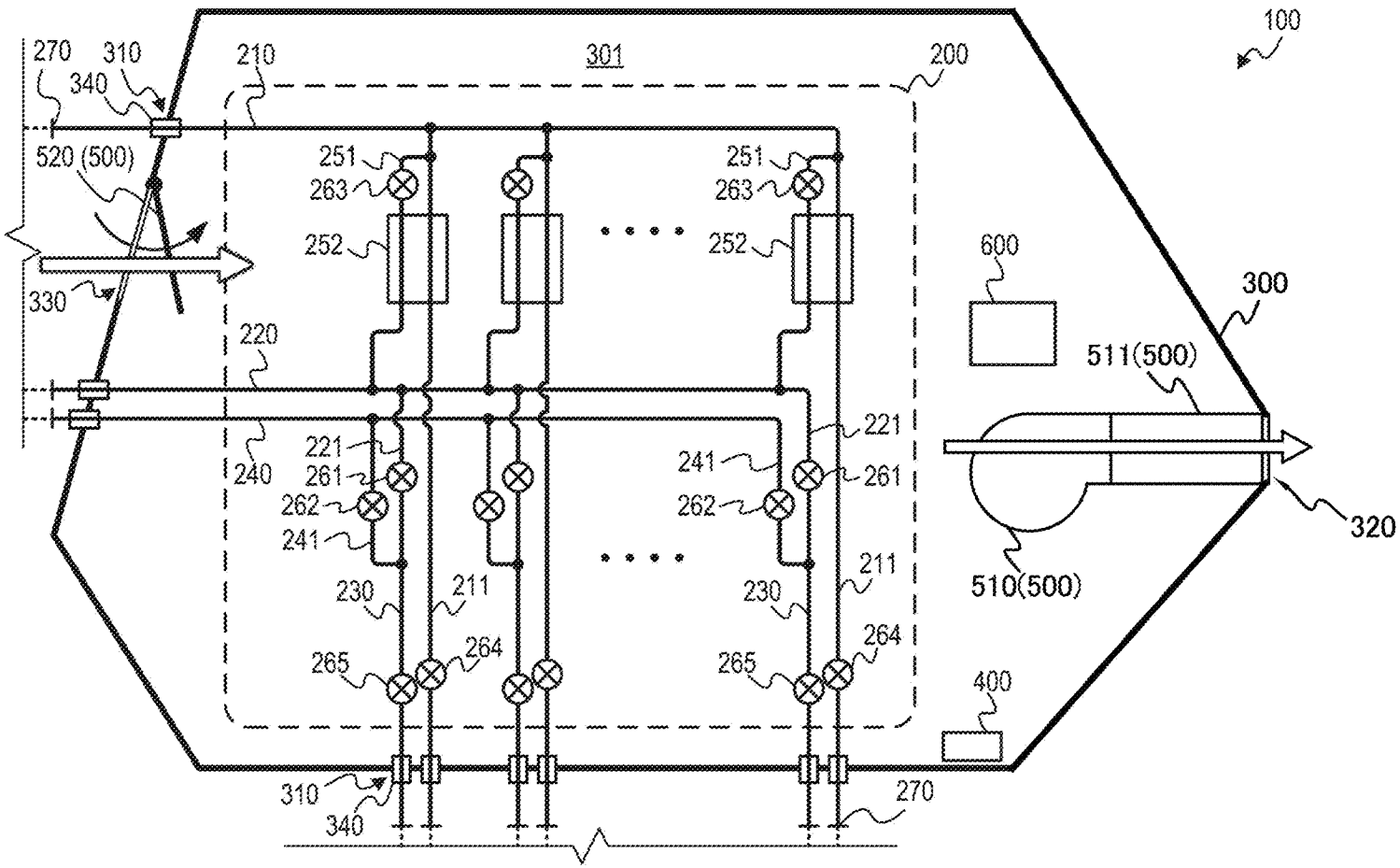
FIG. 5 shows a schematic configuration diagram of a valve unit according to one or more embodiments of the present disclosure.

The discharge opening 320 is configured to allow an air which is in the internal space 301 of the casing 300 (hereinafter referred to as "the internal air") to pass therethrough towards an external space outside the casing 300 by a suction force of the fan 510. As shown in FIG. 1, the fan 510 is disposed outside the casing 300, and a suction port of the fan 510 is connected to the discharge opening 320 of the casing 300 by an air duct 511, which is also a part of the air-discharge mechanism 500. The discharge port of the fan 510 may face an outdoor space. Alternatively, as shown in FIG. 5, the fan 510 may be mounted to the casing 300 at the discharge opening 320 such that a suction port of the fan 510 faces the internal space 301 of the casing 300 and a discharge port of the fan 510 faces the outside of the casing 300. The fan 510 may also be disposed inside the casing. In this case, the discharge opening 320 may be connected to the discharge port of the fan 510 by an internal air duct which is also a part of the air-discharge mechanism 500.

The intake opening 330 is configured to allow an air to flow from the outside of the casing 300 towards the internal space 301 of the casing 300 through the check air damper 520. As shown in FIG. 1, the check air damper 520 may be mounted to the casing 300 at the intake opening 330. Alternatively, in an arrangement where the check air damper 520 is disposed inside the casing, the intake opening 330 may be connected to the check air damper 520 by an air duct which is also a part of the air-discharge mechanism 500. In an arrangement where the check air damper 520 is disposed outside the casing, the intake opening 330 may be connected to the check air damper 520 by an air duct which is also a part of the air-discharge mechanism 500.

The casing 300 may have a maintenance door (not shown) configured to allow the monitoring/maintenance person to check the state of the multi branch selector 200 and/or repair the multi branch selector 200 through the opened door as necessary.

Insulators are applied to the casing 300 such that the internal space 301 of the casing 300 is isolated from an outer space surrounding the casing 300 at least when the air-discharge mechanism 500 is not in operation. The insulators may include insulators 340 fitted into the gaps between outer surfaces of the extending pipes of the multi branch selector 200 and inner edges of the pipe apertures 310, respectively.

Each insulator 340 may be a foam tube, a foam wrap, a foam filler, a caulk, a tape, or the like. The foam tube with a cut line extending in its axis direction is easy to fit into the gap. The thickness of the foam tube may be equal to or slightly greater than the clearance between the outer surface of the corresponding extending pipe and the inner surface of the corresponding pipe aperture 310. The insulators 340 may be attached to the extending pipes before assembling the casing 300. The insulators may also be applied to other gaps in the casing 300, such as the gap between the fan 510 and the discharge opening 320, the gap between the check air damper 520 and the intake opening 330, the gap between the adjoining casing parts, and the gap between the maintenance door and the casing 300.

The sensor 400 is disposed in the internal space 301 of the casing 300. In a case where refrigerant which is heavier than an air, such as R32 refrigerant, the sensor 400 may be disposed on or close to an inner bottom surface of the casing 300. The sensor 400 is configured to detect (or measure) a concentration of the refrigerant in an air surrounding the sensor 400 and output a detection (or measurement) value indicating the detected (or measured) concentration by means of a signal to the controller 600. The sensor 400 may output the detection value (hereinafter referred to as "the sensor detection value Vs") continuously or regularly. The sensor 400 may be a semi-conductor gas sensor reactive to the refrigerant used in the heat-pump system.

As mentioned later, it is determined by the controller 600 whether a refrigerant leakage in the casing 300 (hereinafter referred to as "the refrigerant leakage") has occurred based on this detection value Vs. However, the sensor 400 may have a function to make this determination by itself.

The air-discharge mechanism 500 is configured to discharge the internal air to the outside of the casing 300 when the refrigerant leakage has occurred. As mentioned above, the air-discharge mechanism 500 includes the fan 510 and the check air damper 520.

The fan 510 is controlled by the later-mentioned controller 600 so as to draw the internal air of the casing 300 towards the outside of the casing 300 when the refrigerant leakage has occurred. As mentioned above, the air duct 511 is arranged between the fan 510 and the discharge opening 320 depending on the position of the fan 510. The fan 510 may also be provided with a check air damper which is configured to prevent an air from passing through the fan 510 when the fan 510 is not in operation.

The check air damper 520 is configured to allow an air to flow from the outside of the casing 300 towards the internal space 301 of the casing 300 through the intake opening 330 when the fan 510 is in operation. As mentioned above, an air duct may be arranged between the check air damper 520 and the intake opening 330 depending on the position of the check air damper 520. The check air damper 520 is also configured to prevent the internal air from flowing out through the intake opening 330 when the fan 510 is not in operation.

More specifically, the check air damper 520 has a flap which is disposed in the air path through the intake opening 330. The flap is configured to switch between a closed position in which the flap substantially closes the air path and an open position in which the flap is displaced towards the internal space 301 side not to close the air path. The check air damper 520 further has a force means such as a spring which forces the flap to the closed position from the internal space 301 side. The force means has force intensity with which the flap is kept in the closed position when the fan 510 is not operating and the flap is moved to and kept in the open position when the fan 510 has started to operate by a suction power of the fan 510.

Alternatively, the force means may be an electric motor controlled by the later-mentioned controller 600 so as to keep the flap in the closes position in normal times and move the flap to the open position when the refrigerant leakage has occurred. In other words, the check air damper 520 may be an electrically controlled damper configured to be operated by an electric motor (not shown), and the controller 600 is configured to control the electric motor so as to open the check air damper 520 at a time when the refrigerant leakage has occurred. In this case, the open position of the flap is not limited the above-mentioned position.

The casing 300 and the air-discharge mechanism 500 may be configured such that the distance between the location where external air flows into the internal space 301 and the location where the internal air flows out from the internal space 301 is long enough to efficiently ventilate the internal space 301. For instance, the discharge opening 320 and the intake opening 330 are arranged on the opposite sides of the casing 300 with respect to the center part of the internal space 301.

The controller 600 is configured to control operation of the valve unit 100 via wired/wireless communication paths (not shown) between the controller 600 and the machineries in the valve unit 100. In particular, the controller 600 is configured to acquire the sensor detection value Vs from the sensor 400 and determine whether the refrigerant leakage has occurred based on the sensor detection value Vs. When the refrigerant leakage has occurred, the controller 600 is configured to start operation of the air-discharge mechanism 500. More specifically, the controller 600 is configured to start operation of the fan 510. In a case where the check air damper 520 has the electric motor as mentioned above, the controller 600 is further configured to control the motor such that the flap is moved from the closed position to the open position.

Furthermore, the controller 600 may be configured to, when a refrigerant leakage in any of the utilization-side piping sections has occurred, control the liquid shut-off valve 264 and the gas shut-off valve 265 defining the utilization-side piping section to close. The controller 600 may also output alarm information when the refrigerant leakage in the casing 300 or the refrigerant leakage in any of the utilization-side piping sections has occurred.

The controller 600 includes an arithmetic circuit such as a CPU (Central Processing Unit), a work memory used by the CPU such as a RAM (Random Access Memory), and a recording medium storing control programs and information used by the CPU such as a ROM (Read Only Memory), although they are not shown. The controller 600 is configured to perform information processing and signal processing by the CPU executing the control programs to control the operation of the valve unit 100. Details of the controller 600 will be explained later.

According to the valve unit 100 with the above configuration, when a refrigerant leakage has occurred in the multi branch selector 200, it is possible to swiftly detect an occurrence of the refrigerant leakage, and discharge the internal air of the casing 300 accommodating the multi branch selector 200 to decrease the concentration of the leaked refrigerant in the internal space 301.

Functional Configuration of Controller

Figure 2:
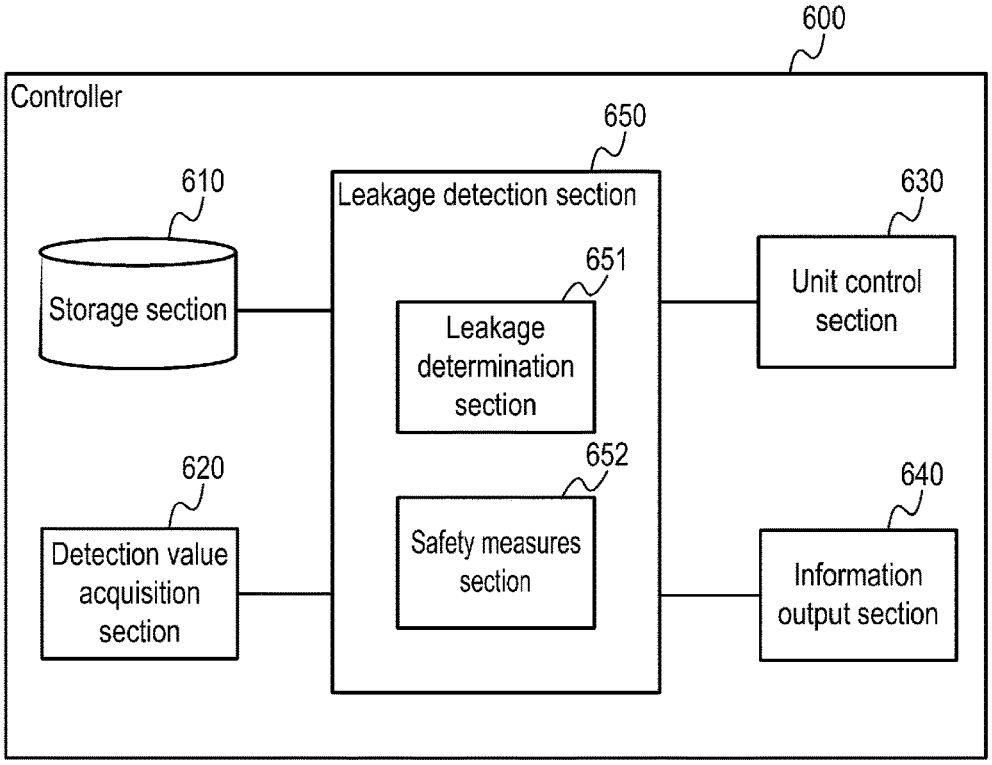
FIG. 2 shows a block diagram indicating a functional configuration of a controller shown in FIG. 1.

FIG. 2 is a block diagram indicating a functional configuration of the controller 600.

As shown FIG. 2, the controller 600 includes a storage section 610, a detection value acquisition section 620, a unit control section 630, an information output section 640, and a leakage detection section 650.

The storage section 610 stores information in a form readable by the leakage detection section 650. The stored information includes a detection value threshold Vth which is used for making a determination whether the refrigerant leakage has occurred. The detection value threshold Vth is determined in advance by experiments or the like such that false detections and detection omissions of refrigerant leakages are avoided as much as possible. The storage section 610 may further store information indicating the relationship between the valves and the utilization-side units and/or the utilization-side piping sections.

The detection value acquisition section 620 is configured to acquire the sensor detection value Vs which is continuously or regularly outputted from the sensor 400 (see FIG. 1). The detection value acquisition section 620 may request the sensor 400 to output the sensor detection value Vs regularly. When the concentration of sensor-reactive substances (i.e. leaked refrigerant) in the internal space 301 varies, the sensor detection value Vs basically reflects this variation substantially in real-time. The detection value acquisition section 620 is configured to pass the acquired sensor detection value Vs to the leakage detection section 650.

The unit control section 630 are configured to control the opening degrees of the low-pressure gas control valves 261, the high-pressure gas control valves 262, and/or the expansion mechanisms 263 (see FIG. 1). For instance, for the pipes connected to the utilization-side unit which should perform cooling operation, the unit control section 630 controls the corresponding low-pressure gas control valve 261 and expansion mechanism 263 to be open and the corresponding high-pressure gas control valve 262 to be closed. For the pipes connected to the utilization-side unit which should perform heating operation, the unit control section 630 controls the corresponding high-pressure gas control valve 262 to be open and the corresponding low-pressure gas control valve 261 and expansion mechanism 263 to be closed. The unit control section 630 may perform such operation based on signals, which indicate the desired operation modes of the utilization-side units, sent from the heatsource-side unit, the utilization-side units, and/or an information output device used by the monitoring/maintenance person.

The unit control section 630 is further configured to control the operations of the air-discharge mechanism 500, the liquid shut-off valves 264, and the gas shut-off valves 265 (see FIG. 1) according to instructions from the leakage detection section 650. For instance, the unit control section 630 controls the operation of the air-discharge mechanism 500 by controlling a supply of electricity thereto.

The information output section 640 is configured to output alarm information indicating an occurrence of the refrigerant leakage, according to instructions from the leakage detection section 650. The information output section 640 outputs the alarm information by means of a sound, a light, and/or a visual image. The information output section 640 may be a loudspeaker, an electric light, and/or a display device. The information output section 640 may include a communication interface device and configured to transmit an alarm signal indicating the alarm information to an external device, such as the heatsource-side unit, the utilization-side units, and/or an information output device used by the monitoring/maintenance person.

The leakage detection section 650 is configured to perform a refrigerant leakage determination and necessary safety measures. The leakage detection section 650 includes a leakage determination section 651 and a safety measures section 652.

The leakage determination section 651 is configured to continuously or regularly compare the sensor detection value Vs with the detection value threshold Vth. The leakage determination section 651 is configured to determine that the refrigerant leakage has occurred if the sensor detection value Vs is equal to or greater than the detection value threshold Vth. The leakage determination section 651 is configured to inform that determination result to the safety measures section 652.

The leakage determination section 651 may be further configured to, when a refrigerant leakage in any of the utilization-side piping sections has occurred, input a signal indicating an occurrence of a refrigerant leakage. The signal may be outputted by a refrigerant leakage detector disposed in the corresponding utilization-side unit or a space which the corresponding utilization-side unit air-conditions. In this case, when the signal has been inputted, the leakage determination section 651 is configured to inform the safety measures section 652 of information indicating the utilization-side unit or the utilization-side piping section with which a refrigerant leakage has occurred.

The safety measures section 652 is configured to take necessary safety measures via the unit control section 630 when it has been determined by the leakage determination section 651 that the refrigerant leakage has occurred in the casing 300. These safety measures include starting the operation of the air-discharge mechanism 500. More specifically, the safety measures section 652 provides an instruction to the unit control section 630 to start the operation of the fan 510, and, if the check air damper 520 is operated by the electric motor, also control the check air damper 520 to open (see FIG. 1).

The safety measures may further include outputting the alarm information and/or transmitting the alarm signal indicating the alarm information by using the information output section 640.

The alarm signal may include a pump-down signal transmitted to a controller of the heatsource-side unit via a wired/wireless communication path (not shown). A controller of the heatsource-side unit (not shown) may be configured to perform a pump-down operation upon receiving the pump-down signal. In the pump-down operation, the following steps are performed: closing a shut-off valve (not shown) disposed in the liquid refrigerant pipe; operating the refrigerant compressor until a predetermined condition is satisfied, e.g. until some parameters indicate an end of pump-down; and closing shut-off valves (not shown) disposed in the low-pressure gas refrigerant pipe and the high-pressure gas refrigerant pipe. Thereby, the refrigerant in the multi branch selector 200 can be retrieved to the heatsource-side unit side.

Instead of controlling the valves in the heatsource-side unit, the safety measures section 652 may control the liquid shut-off valves 264, the expansion mechanisms 263, and the high-pressure gas control valves 262 to be closed and the gas shut-off valves 265 and the low-pressure gas control valves 261 to be open before operation of the refrigerant compressor. After the predetermined condition mentioned above has been satisfied, the safety measures section 652 may control the gas shut-off valves 265 and the low-pressure gas control valves 261 to be closed.

The safety measures section 652 may be further configured to, when the utilization-side piping section or the utilization-side piping section with which a refrigerant leakage occurred has been informed of from the leakage determination section 651, control the corresponding liquid shut-off valves 264 and the gas shut-off valves 265 (see FIG. 1) to close via the unit control section 630. The safety measures section 652 may also output the alarm information and/or the alarm signal indicating the occurrence of the refrigerant leakage in the utilization-side piping section.

The safety measures section 652 does not make the operation of the air-discharge mechanism 500 get started unless it has been determined that the refrigerant leakage has occurred. Yet, the safety measures section 652 may do that when an instruction has been received from the monitoring/maintenance person via a user interface (not shown) of the valve unit 100 such as a key switch, a touch panel or the like, or from an external device by means of a signal. For instance, the signal is generated and sent by the heatsource-side unit and transmitted by wired/wireless communication.

According to the controller 600 with the above configuration, it is possible to determine whether the refrigerant leakage has occurred during the air-discharge mechanism 500 is not in operation. When the air-discharge mechanism 500 is not operating, the internal space 301 of the casing 300 is substantially closed because of the insulators. Thus, when the refrigerant leakage has occurred in the multi branch selector 200, leaked refrigerant accumulates in the internal space 301, and thus an occurrence of a refrigerant leakage can be swiftly detected. Moreover, when an occurrence of the refrigerant leakage has been detected, it is possible to decrease the concentration of the leaked refrigerant in the internal space 301 by the operation of the air-discharge mechanism 500.

The controller 600 may be separated into a first controller having the functions for controlling the multi branch selector 200 and a second controller having the functions for controlling the air-discharge mechanism 500, the liquid shut-off valves 264, and the gas shut-off valves 265. With this configuration, the first and second controllers may have different electricity sources.

Operation of Controller

Figure 3:
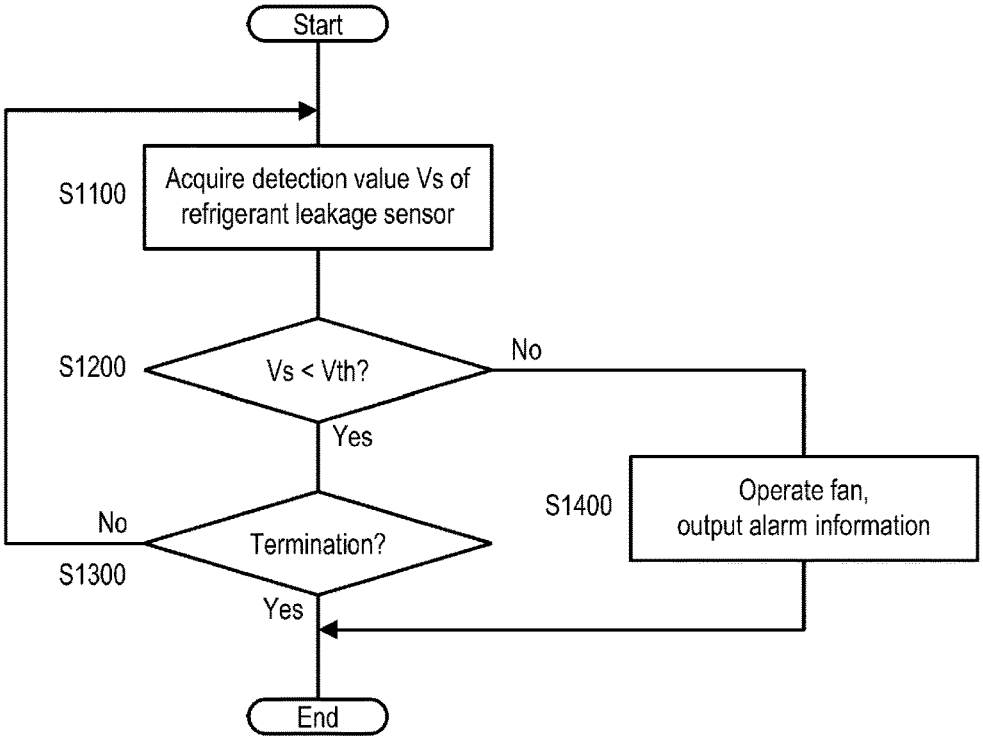
FIG. 3 shows a flow chart indicating a process performed by the controller.

FIG. 3 is a flow chart indicating a process performed by the controller 600.

In step S1100, the leakage determination section 651 acquires the sensor detection value Vs from the semiconductor gas sensor 400 via the detection value acquisition section 620.

In step S1200, the leakage determination section 651 compares the sensor detection value Vs and the detection value threshold Vth, and determines whether the sensor detection value Vs is less than the detection value threshold Vth. The detection value acquisition section 620 or the leakage determination section 651 may obtain a moving average value of the sensor detection values Vs in a certain time length, and use the moving average value as the sensor detection value Vs to be compared with the detection value threshold Vth in step S1200. If the sensor detection value Vs is less than the detection value threshold Vth (S1200: Yes), the leakage determination section 651 proceeds to later-mentioned step S1300, and if the sensor detection value Vs is equal to or greater than the detection value threshold Vth (S1200: No), proceeds to step S1400.

In step S1300, the leakage detection section 650 determines whether a termination of operation has been designated. The designation may be made by a user operation, another device, or the leakage detection section 650 itself. If the termination of the operation has not been designated (S1300: No), the leakage detection section 650 proceeds back to step S1100, and if designated (S1300: Yes), terminates its operation.

In step S1400, the safety measures section 652 starts the operation of the fan 510 via the unit control section 630, and outputs the alarm information via the information output section 640. In the case where the check air damper 520 is the electrically controlled damper, the safety measures section 652 also control the check air damper 520 to open.

By the above process, the controller 600 can properly and promptly detect the refrigerant leakage and decrease the concentration of the leaked refrigerant in the internal space 301 of the casing 300. More specifically, the concentration of refrigerant in the internal space 301 can be prevented from going beyond the detection value threshold Vth. The detection value threshold Vth may be set to a value less than a value corresponding to 25% of the Lower Flammability Limit (LFL) of the refrigerant used.

Advantageous Effect

As described above, the valve unit 100 according to one or more embodiments has the casing 300 for accommodating the multi branch selector 200 and the air-discharge mechanism 500 configured to discharge the air in the internal space of the casing 300 to the external space outside of the casing 300 when the refrigerant leakage has occurred. Thereby, when a refrigerant leakage has occurred in the multi branch selector 200, it is possible to swiftly detect it, and decrease the concentration of the leaked refrigerant in the space where the multi branch selector 200 is disposed. Hence, it is possible for the monitoring/maintenance person to safely check the state of the multi branch selector 200 and/or repair the multi branch selector 200 as necessary, and maintainability and safety of the air-conditioning system can thus be improved.

MODIFICATIONS

The above-mentioned configuration and process of the valve unit 100 may be modified in accordance with circumstances.

For instance, the casing 200 may further include pressure-relief valves. The pressure-relief valves may be disposed in bypass pipes (not shown) each branching from the corresponding utilization-side liquid pipe portion 211 at a point between the corresponding pipe aperture 310 of the casing 300 and the corresponding shut-off valve 264 and merging with the low-pressure gas pipe portion 220. The bypass pipes may be individually connected with the low-pressure gas pipe portion 220, or merge to a common pipe leading to the low-pressure gas pipe portion 220. Thereby, it is possible to release pressure from the utilization-side piping section to prevent the utilization-side piping section from causing liquid seal even when the corresponding liquid shut-off valve 264 and gas shut-off valve 265 are closed.

The liquid shut-off valve 264 may be further disposed in the heatsource-side liquid pipe portion 210, and the gas shut-off valve 265 may be further disposed in each of the low-pressure gas pipe portion 220 and the high-pressure gas pipe portion 240. In this case, the controller 600 may control all the liquid shut-off valves 264 and the gas shut-off valves 265 to close when the refrigerant leakage in the casing 300 has occurred. Thereby, when a refrigerant leakage in the casing 300 has occurred, further refrigerant inflow into the multi branch selector 200 is prevented. The controller 600 may also be configured to close the liquid shut-off valves 264 and the gas shut-off valves 265 when there is a power failure in the valve unit 100. In this case, the controller 600 may include capacitors that can store electric energy, and is configured to release this energy by discharging the capacitors when there is power failure to close the liquid shut-off valves 264 and the gas shut-off valves 265.

The air-discharge mechanism 500 does not necessarily need the fan 510 and the check air damper 520. For instance, if ventilation of the internal air can be achieved just by opening one or more of openings which are formed in the casing 300 and are normally closed, the air-discharge mechanism 500 may be a mechanism configured to control the open/closed state of the openings, such as electrically controlled check dampers. Natural convection or an air flow caused by an external mechanism may be utilized for such a ventilation.

Another fan configured to blow air towards the internal space may be disposed instead of or in addition to the check air damper 520. In this case, the capacity of this additional fan may be determined such that the air pressure in the internal space 301 is kept lower than the air pressure in the space surrounding the casing 300 in combination with the capacity of the fan 510.

If refrigerant used is heavier than air and thus it is permissible to form gaps or openings in the upper part of the casing 300, the check air damper 520 is not necessarily needed. If the isolation of the internal space 301 of the casing 300 is sufficient without any specific insulators, such insulators may be omitted. In this case, however, at least an opening for discharging the internal air and another opening for easing this air discharge should be formed in the casing 300.

The casing 300 may accommodate not the multi branch selector 200 but another type of unit which has at least one liquid refrigerant pipe portion, at least one gas refrigerant pipe portion, at least one liquid control valve disposed in the liquid refrigerant pipe portion, and at least one gas control valve disposed in the gas refrigerant pipe portion. Each of the liquid control valve and the gas control valve may be any type of valve for controlling flow of refrigerant in the corresponding pipe portion.

Figure 4:
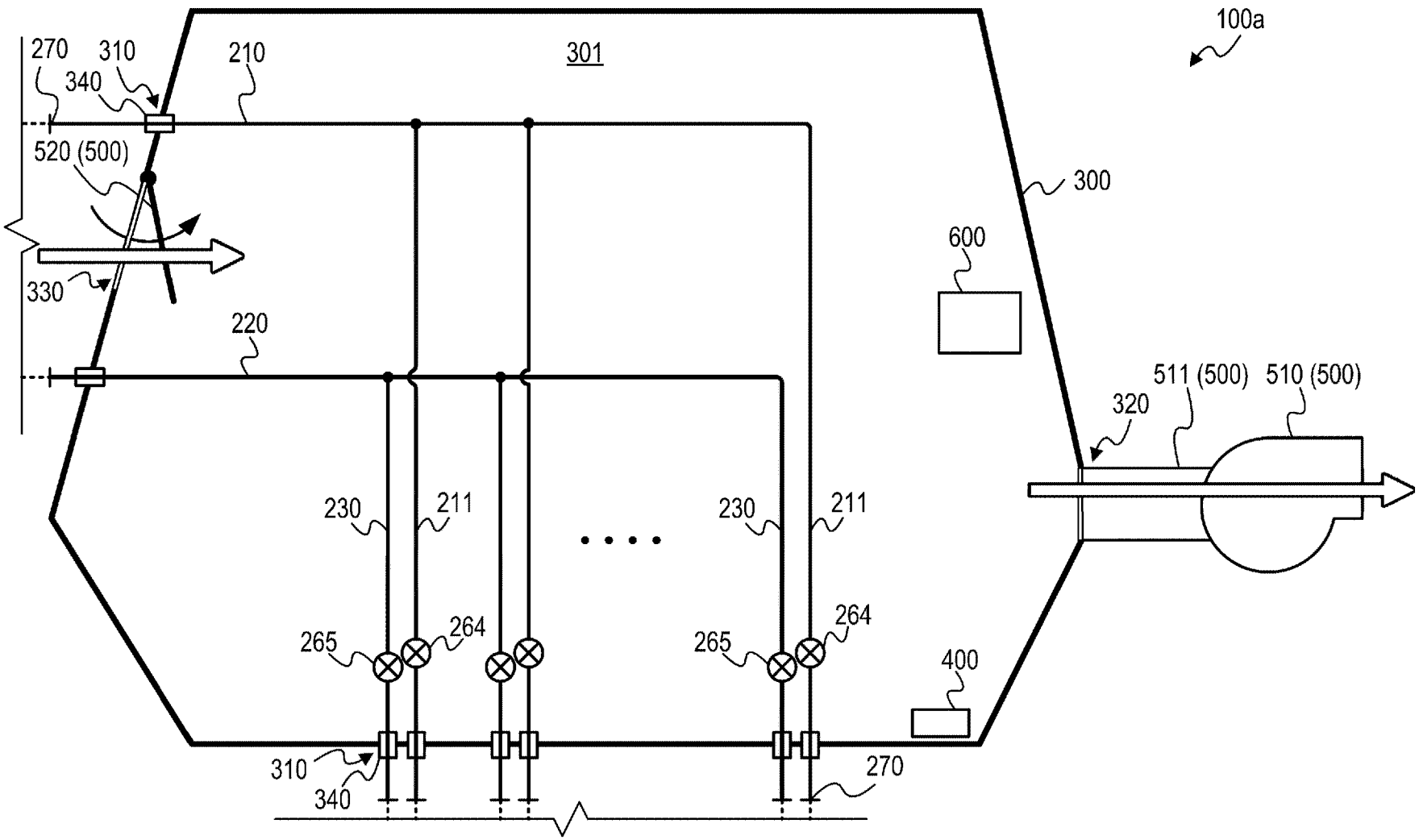
FIG. 4 shows a schematic configuration diagram of a valve unit according to a modification of the embodiments.

For instance, as shown in FIG. 4, the valve unit 100*a* may be applied to a heat-pump system with a so-called two-pipe configuration. Compared with the configuration shown FIG. 1, the valve unit 100*a* as a modification of the embodiments described above does not have the high-pressure gas pipe portion 240, the low-pressure gas sub pipes 221, the high-pressure gas sub pipes 241, the bypass pipes 251, the refrigerant heat exchangers 252, the low-pressure gas control valves 261, the high-pressure gas control valves 262, and the expansion mechanisms 263. In addition to this, or alternatively, the valve unit may have configuration for only a single utilization-side unit.

The safety measures section 652 may, when a valve close instruction has been received, close the liquid shut-off valves 264 and the gas shut-off valves 265 via the unit control section 630. This situation would occur, for instance, when the monitoring/maintenance person is starting to maintain or repair the utilization-side piping sections. The leakage detection section 650 may accept a reset instruction from the monitoring/maintenance person via the user interface or from the external device by means of a signal. If the reset instruction has been made, the leakage detection section 650 may open the liquid shut-off valves 264 and the gas shut-off valves 265.

All or a part of the controller 600 may be separated from the valve unit 100. In this case, the valve unit 100 should have a communication interface such that the controller 600 can acquire the sensor detection value Vs of the sensor 400 and control the operation of the machineries of the valve unit 100 including the air-discharge mechanism 500.

If the discharge of the internal air is performed continuously or regularly, under the control of the controller 600 for instance, the refrigerant leakage does not necessarily need to be performed, and thus the sensor 400 is not required. In this case, the process shown in FIG. 3 is not necessarily required.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

100, 100*a*: Valve unit
200: Multi Branch Selector
210: Heatsource-side Liquid Pipe Portion (Liquid Refrigerant Pipe Portion)
211: Utilization-Side Liquid Pipe Portion (Liquid Refrigerant Pipe Portion)
220: Low-Pressure Gas Pipe Portion (Gas Refrigerant Pipe Portion, Heatsource-Side Gas Pipe Portion)
221: Low-pressure Gas Sub pipe (Gas Refrigerant Pipe Portion)
230: Utilization-Side Gas Pipe Portion (Gas Refrigerant Pipe Portion)
240: High-Pressure Gas Pipe Portion (Gas Refrigerant Pipe Portion, Heatsource-Side Gas Pipe Portion)
241: High-Pressure Gas Sub Pipe (Gas Refrigerant Pipe Portion)
251: Bypass Pipe
252: Refrigerant Heat Exchanger
261: Low-Pressure Gas Control Valve (Gas Control Valve)
262: High-Pressure Gas Control Valve (Gas Control Valve)
263: Expansion Mechanism
264: Liquid Shut-Off Valve (Liquid Control Valve)
265: Gas Shut-Off valve (Gas Control Valve)
270: Pipe Connection Part
300: Casing
301: Internal Space
310: Pipe Aperture
320: Discharge Opening
330: Intake Opening
340: Insulator
400: Sensor
500: Air-Discharge Mechanism
510: Fan
511: Air Duct
520: Check Air Damper
600: Controller
610: Storage Section
620: Detection Value Acquisition Section
630: Unit Control Section
640: Information Output Section
650: Leakage Detection Section
651: Leakage Determination Section
652: Safety Measures Section

PATENT LITERATURE

[PTL 1] EP 3 091 314 A1

What is claimed is:

1. A valve unit for a heat-pump system including a liquid refrigerant pipe and a gas refrigerant pipe, the valve unit comprising:
- a liquid refrigerant pipe portion of the liquid refrigerant pipe;
- a gas refrigerant pipe portion of the gas refrigerant pipe, wherein
  - the liquid refrigerant pipe and the gas refrigerant pipe both extend between a heatsource-side heat exchanger in a heatsource-side unit and a utilization-side heat exchanger in a utilization-side unit;
- a liquid control valve disposed in the liquid refrigerant pipe portion;
- a gas control valve disposed in the gas refrigerant pipe portion;
- a casing that has an intake opening and a discharge opening and that accommodates the liquid control valve and the gas control valve; and
- an air-discharge mechanism that comprises:
  - a check air damper mounted at the intake opening of the casing and that allows air to flow from an outside of the casing towards an internal space of the casing through the intake opening of the casing;
  - a fan that is disposed outside the casing, that comprises a suction port and a discharge port facing an outdoor space, and that draws air from the internal space of the casing towards the outdoor space; and
  - an air duct that connects the discharge opening of the casing to the suction port of the fan, wherein
- the air-discharge mechanism discharges the air in the internal space of the casing to the outdoor space in response to a refrigerant leakage in the casing by operating the fan and keeping the check air damper in an open position.

2. The valve unit according to claim 1, further comprising:
- a sensor that measures a concentration of a refrigerant in the air in the casing; and
- a controller that:
  - determines that the refrigerant leakage in the casing has occurred when the measured concentration is equal to or greater than a detection value threshold, and
  - controls the air-discharge mechanism to start discharge of the air when the refrigerant leakage has occurred.

3. The valve unit according to claim 2, wherein the controller controls the liquid control valve and the gas control valve to close in response to a refrigerant leakage in a utilization-side piping section that extends between the liquid control valve and the gas control valve and that comprises a utilization-side heat exchanger.

4. The valve unit according to claim 3, wherein the controller outputs alarm information in response to occurrence of the refrigerant leakage in the casing or in response to occurrence of the refrigerant leakage in the utilization-side piping section.

5. The valve unit according to claim 2, wherein
the casing comprises an opening,
the air-discharge mechanism further comprises a check air damper that allows air to flow from an outside of the casing towards the internal space through the opening when the fan draws the air,
the check air damper is configured to be operated by an electric motor, and
the controller controls the electric motor to open the check air damper in response to occurrence of the refrigerant leakage in the casing.

6. The valve unit according to claim 1, wherein
the gas refrigerant pipe portion comprises:
a low-pressure gas pipe portion;
a high-pressure gas pipe portion; and
a utilization-side gas pipe portion branching into the low-pressure gas pipe portion and the high-pressure gas pipe portion,
the liquid control valve comprises a liquid shut-off valve in the liquid refrigerant pipe portion, and
the gas control valve comprises:
a low-pressure gas control valve in the low-pressure gas pipe portion;
a high-pressure gas control valve in the high-pressure gas pipe portion; and
a gas shut-off valve in the utilization-side gas pipe portion.

7. The valve unit according to claim 6, wherein at least one of the low-pressure gas control valve and the high-pressure gas control valve comprises a minute channel that enables refrigerant to flow through the minute channel even when an opening degree of the at least one of the low-pressure gas control valve and the high-pressure gas control valve is set to be lowest.

8. The valve unit according to claim 1, wherein
the liquid refrigerant pipe portion comprises:
utilization-side liquid pipe portions; and
a heatsource-side liquid pipe portion branching into the utilization-side liquid pipe portions,
the gas refrigerant pipe portion comprises:
utilization-side gas pipe portions; and
a heatsource-side gas pipe portion branching into the utilization-side gas pipe portions,
the liquid control valve comprises liquid shut-off valves each disposed in each of the utilization-side liquid pipe portions,
the gas control valve comprises gas shut-off valves each disposed in each of the utilization-side gas pipe portions.

9. The valve unit according to claim 1, wherein
the liquid refrigerant pipe portion comprises:
utilization-side liquid pipe portions; and
a heatsource-side liquid pipe portion branching into the utilization-side liquid pipe portions,
the gas refrigerant pipe portion comprises:
low-pressure gas sub pipes;
a low-pressure gas pipe portion branching into the low-pressure gas sub pipes;
high-pressure gas sub pipes;
a high-pressure gas pipe portion branching into the high-pressure gas sub pipes; and
utilization-side gas pipe portions each branching into one of the low-pressure gas sub pipes and one of the high-pressure gas sub pipes such that each of the utilization-side gas pipe portions is connected to the low-pressure gas pipe portion and the high-pressure gas pipe portion via the one of the low-pressure gas sub pipes and the one of the high-pressure gas sub pipes,
the liquid control valve comprises liquid shut-off valves each disposed in each of the utilization-side liquid pipe portions, and
the gas control valve comprises:
low-pressure gas control valves each disposed in each of the low-pressure gas sub pipes;
high-pressure gas control valves each disposed in each of the high-pressure gas sub pipes; and
gas shut-off valves each disposed in each of the utilization-side gas pipe portions.

10. The valve unit according to claim 1, further comprising insulators applied to the casing such that the insulators isolate the internal space of the casing from an outer space surrounding the casing when the air-discharge mechanism is not discharging the air.

11. The valve unit according to claim 1, wherein a refrigerant is R32 refrigerant.

12. A method for assembling the valve unit according to claim 1, wherein the casing is made of casing parts, comprising:
disposing the casing parts around the liquid control valve and the gas control valve; and
fixing the casing parts to each other.

13. The method according to claim 12, further comprising attaching the air-discharge mechanism to the casing.

14. The valve unit according to claim 1, wherein the check air damper is configured to prevent an internal air from flowing out through the opening when the fan is not in operation.

15. The valve unit according to claim 1, wherein the check air damper comprises a flap in an air path through the opening.

16. A valve unit for a heat-pump system including a liquid refrigerant pipe and a gas refrigerant pipe, the valve unit comprising:
a liquid refrigerant pipe portion of the liquid refrigerant pipe;
a gas refrigerant pipe portion of the gas refrigerant pipe, wherein
the liquid refrigerant pipe and the gas refrigerant pipe both extend between a heatsource-side heat exchanger in a heatsource-side unit and a utilization-side heat exchanger in a utilization-side unit;
a liquid control valve disposed in the liquid refrigerant pipe portion;
a gas control valve disposed in the gas refrigerant pipe portion;
a casing that has an intake opening and a discharge opening and that accommodates the liquid control valve and the gas control valve; and
an air-discharge mechanism that comprises:
a check air damper mounted at the intake opening of the casing and that allows air to flow from an outside of the casing towards an internal space of the casing through the intake opening of the casing;
a fan that is disposed inside the casing, that comprises a discharge port facing an outdoor space, and that draws air from the internal space of the casing towards the outdoor space; and
an air duct that connects the discharge port of the fan to the discharge opening of the casing, wherein
the air-discharge mechanism discharges the air in the internal space of the casing to the outdoor space in response to a refrigerant leakage in the casing by operating the fan and keeping the check air damper in an open position.

* * * * *